United States Patent [19]

Rodinsky

[11] 3,958,286

[45] May 25, 1976

[54] FIRE EXTINGUISHING MATTRESS COVER

[76] Inventor: Theodore F. Rodinsky, 24476 Schoolcraft, Detroit, Mich. 48223

[22] Filed: July 1, 1974

[21] Appl. No.: 484,600

[52] U.S. Cl. ..... 5/335; 5/354; 297/DIG. 5

[51] Int. Cl.[2] ..... A47G 9/00

[58] Field of Search ..... 5/335, 336, 344, 348, 5/348 WB, 354; 297/DIG. 5

[56] References Cited

UNITED STATES PATENTS

| | | | |
|---|---|---|---|
| 2,481,833 | 9/1949 | Foster | 5/348 R |
| 2,801,427 | 8/1957 | Crocker | 5/354 |
| 2,886,833 | 5/1959 | Enger | 5/354 |
| 3,253,861 | 5/1966 | Howard | 5/348 R |
| 3,296,635 | 1/1967 | O'Hanlan | 5/348 R |

*Primary Examiner*—Casmir A. Nunberg
*Attorney, Agent, or Firm*—Alex Rhodes

[57] ABSTRACT

A liquid filled cover for a mattress having horizontally disposed upper and lower sheets of a material having a low resistance to penetration by fire and hot objects capable of initiating fire joined at their outermost edges to form a leakproof enclosure. After filling the enclosure with a fire extinguishing liquid, the filled height of the cover is relatively small as compared to its length and breadth. The upper sheet contains a closure for adding or removing liquid and a plurality of symmetrically opposed depressions within the upper and lower sheets of the liquid filled cover provide desired shape and load supporting characteristics. A retaining means positions and retains the cover to the top surface of a mattress. The liquid filled cover when interposed between a mattress and a sleeping occupant provides protection and warning to the occupant when the cover is punctured by fire or hot objects, whereby the released liquid acts to suppress the fire and awake the occupant.

11 Claims, 8 Drawing Figures

FIRE EXTINGUISHING MATTRESS COVER

BACKGROUND OF THE INVENTION

In the event of fire, sleeping occupants of beds have a high exposure to danger from burns and smoke inhalation. Careless use of cigarettes, cigars, and pipes and other causes such as faulty wiring have resulted in private dwelling, apartment, hotel and ship fires with tragic physical injuries, loss of life and property, and increased costs of insurance.

One method which has been developed to reduce the danger from fires involving bedding materials is to treat materials with fire retardants. However, this method produces only partial safety improvements since other non-treated materials such as clothing and newspapers are often present and repeated washing of a chemically treated bedding material will reduce its effectiveness by loss of fire-retardant chemicals. Furthermore, fire-retardant chemicals may cause skin irritations in some individuals.

A second method developed for reducing the danger from fire to sleeping occupants of beds is the use of non-flammable materials for bedding. For example, fire resistant mattress covers have been made from fiberglass. Non-flammable materials are generally inorganic, relatively high in cost, and difficult to join. Also, asbestos, a commonly known non-flammable material, is believed to be cancer producing.

A third method for reducing the danger from bedding fires is the use of specially constructed mattresses having internally disposed elements such as liquid filled cells or non-flammable padding. However, specially constructed mattresses are relatively high in cost, offer only limited protection and result in economic loss when an existing mattress must be discarded. In the event of fire, a mattress having non-flammable internal elements would not act to quickly extinguish the fire in other existing non-flammable materials.

Although the foregoing methods to some measure tend to reduce the hazards of fire, none of them have found widespread use. Therefore, a device is clearly needed which is low in cost, effective for reducing hazards of bedding fires and adaptable to currently used types of bedding.

SUMMARY OF THE INVENTION

The present invention is directed towards a low cost cover containing a fire-extinguishing liquid which can be applied to mattresses in current use, whereby the materials used for constructing the cover having a low resistance to penetration by fire or other hot objects will release the contained liquid and reduce physical injuries and property losses caused by fire. A further object of the present invention is a higher comfort level for the occupant of a bed by providing a surface having improved load supporting characteristics.

Upper and lower horizontally disposed sheets of material having a low resistance to penetration by fire and hot objects capable of initiating fire are joined at their outermost edges to form a leakproof enclosure. A closure is provided in the upper sheet for filling the enclosure with a fire extinguishing liquid. The height of the liquid filled cover is relatively small as compared to its length and breadth and the cover in juxtaposition to the upper surface of a mattress substantially covers the mattress. Flaps with transverse passageways and a cord threaded through the passageways retain the cover to the mattress. Symmetrically opposed depressions in the upper and lower sheets of the liquid filled cover provide desired shape and load supporting characteristics for the cover.

Further features and benefits of the present invention will be apparent from the following description with reference to the accompanying drawings.

DETAILED DESCRIPTION OF THE INVENTION

Figure 1:
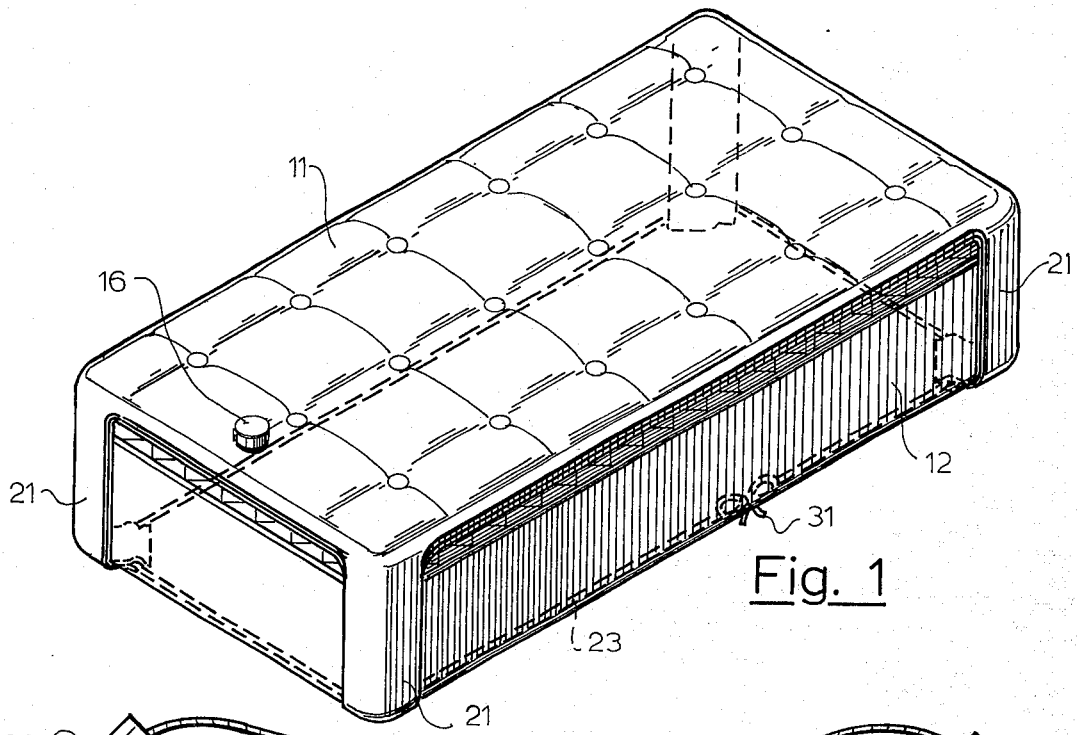
FIG. 1 is a perspective view of the first embodiment of the present invention retained to the upper surface of a mattress.

Referring to FIGS. 1 through 4, the first embodiment of the present invention, a fire extinguishing mattress cover, generally designated as 11, is shown, being retained in FIG. 1 to a mattress, designated as 12. The mattress 12 has the overall shape and proportions of mattresses commonly used for single and double size beds; however, mattresses having other shapes and proportions can be used with the present invention. The mattress cover 11 forms a leakproof enclosure filled with a fire extinguishing liquid 14 such as ordinary water, in juxtaposition to and substantially covering the top surface of the mattress 12. Clearly, different size and shape mattresses will require covers having unique sizes and shapes. The liquid filled height of the cover 11 is relatively small in comparison to its length and breadth and is within the range of one half to three inches, the preferred height of the liquid filled cover being approximately 1½ inches.

Figure 2:
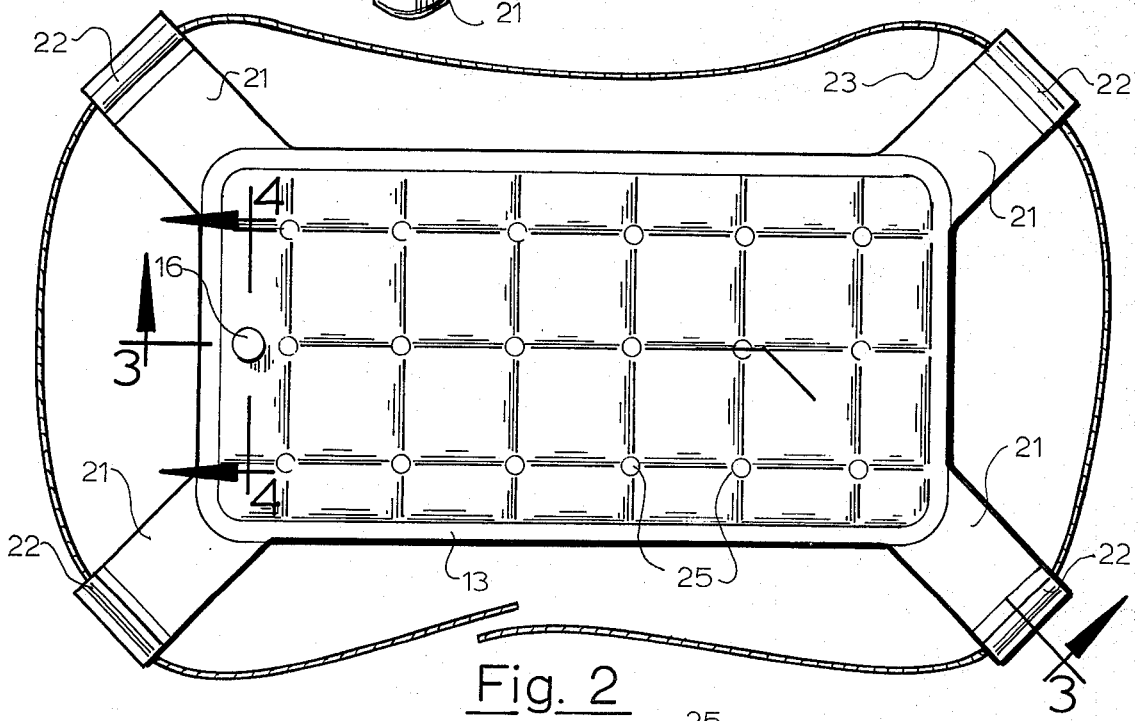
FIG. 2 is a plan view of the cover shown in FIG. 1 prior to being retained to a mattress.
Figure 3:
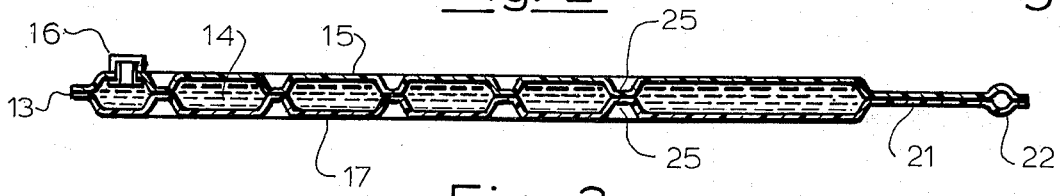
FIG. 3 is a sectional view taken in the direction of arrows 3—3 in FIG. 2.

The cover 11 prior to being attached to the mattress 12 is shown in FIGS. 2 and 3. Two identically sized sheets, an upper and lower sheet 15 and 17, respectively, have a flap 21 at each of their four corners. The sheets 15 and 17 are joined around their outermost edges by a continuous seam 13 to form a leakproof enclosure. A plurality of circular connections of the upper sheet 15 to the lower sheet 17 produces symmetrically opposed circular depressions 25 in sheets 15 and 17 upon filling the cover 11 with liquid 14, said depressions providing desired shape and load supporting characteristics of the cover 11.

At the end of each corner flap 21 is a transverse passageway 22 through which a cord 23 is passed for retaining the cover 11 to the mattress 12. The passageways 22 are formed by transverse parallel connections of the upper sheet 15 to the lower sheet 17 with an intervening space. The material used for the cord 23 may optionally be elastic.

Figure 4:
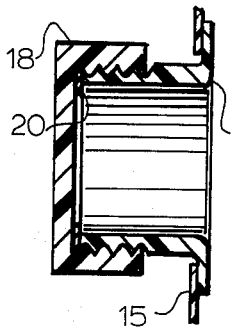
FIG. 4 is an enlarged sectional view taken in the direction of arrows 4—4 in FIG. 2.

Affixed to the upper sheet 15 is a closure, generally designated 16 for filling the cover with a fire extinguishing liquid 14 such as ordinary water. The closure 16, as shown in detail in FIG. 4, is comprised of a threaded cap 18, inlet tube 19 having opposite ends flanged and threaded and a gasket 20. The closure 16 is a type commonly used for adding liquids; however, other types of closures may be used with the present invention.

A preferred material for the upper and lower sheets 15 and 17 should have a low resistance to penetration by fire and hot objects capable of initiating fire. In addition, the material should be relatively low in cost, durable, capable of forming a leakproof enclosure and easily joined by existing methods. One group of materials meeting these requirements is the plasticized vinyl films having a thickness range of one half thousandth to sixty thousandths of an inch.

To construct the cover 11, existing methods such as adhesive bonding may be used for making a continuous seam in the upper and lower sheets 15 and 17 to form a leakproof enclosure and the circular depressions 25. Adhesive bonding may also be used for attaching the flanged end of the inlet tube 19 to the upper sheet 15. Where thermoplastic materials are used such as the plasticized vinyl films, specified as a preferred material for the upper and lower sheets 15 and 17, the joining method of heat sealing is suitable.

Referring to FIG. 1, the first embodiment 11 is retained to the mattress 12 by folding the corner flaps 21 over the corners of the mattress 12 and tying the ends of the cord 23 in a knot 31.

Figure 5:
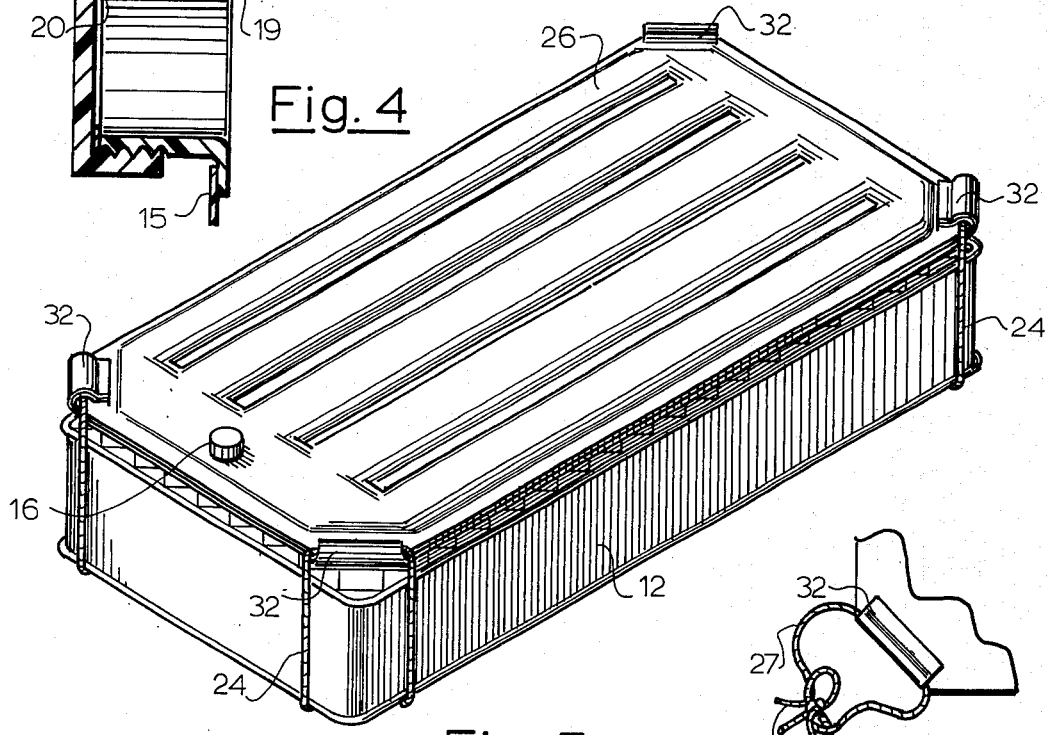
FIG. 5 is a perspective view of a second embodiment of the present invention retained to the upper surface of a mattress.
Figure 6:
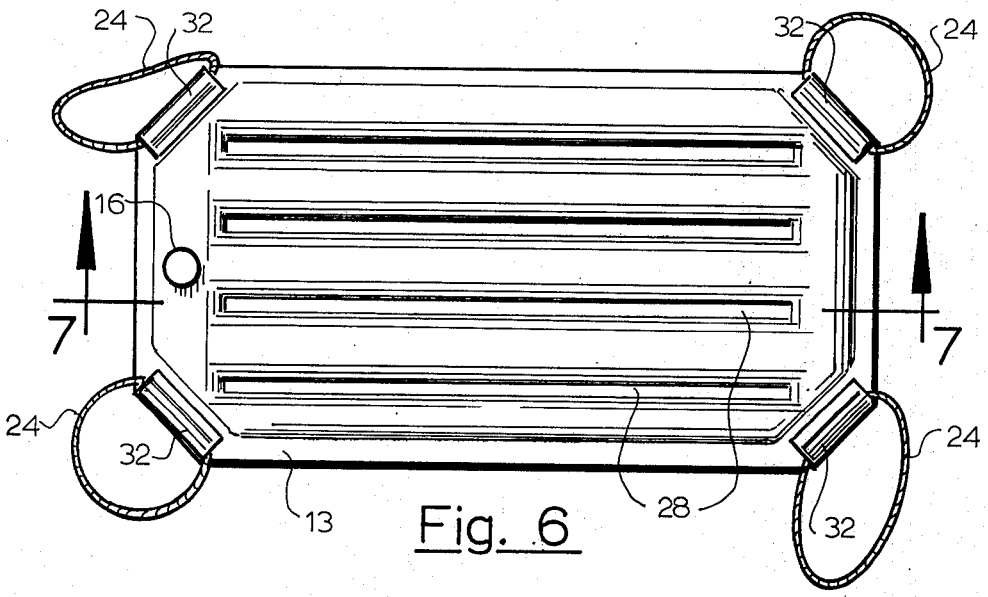
FIG. 6 is a plan view of the cover shown in FIG. 5 prior to being retained to a mattress.
Figure 7:
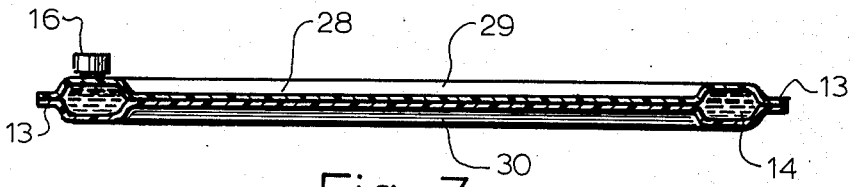
FIG. 7 is a sectional view taken in the direction of arrows 7—7 in FIG. 6.

In FIGS. 5 through 7, the second embodiment of the present invention, generally designated as 26, is shown being retained in FIG. 5 to the mattress 12. The upper and lower sheets of the second embodiment 26 which form a leakproof enclosure filled with a fire extinguishing liquid 14, are designated as 29 and 30, respectively. The upper and lower sheets 29 and 30 are identically sized having flaps 32 at each of their four corners, containing transverse passageways generally similar to those of the cover 11 of the first embodiment. However, the flaps 32 of the cover 26 of the second embodiment are cut shorter than the flaps 21 of the cover 11 of the first embodiment and the transverse passageways of the flaps 32 are formed by folding and joining the free end of each flap 32 onto itself. Separate loop shaped cords 24, optionally elastic, are provided at each corner of the cover 26, said cords 24 being installed prior to joining the free ends of the flaps 32 to form the transverse passageway s. Symmetrically opposed longitudinal depressions 28 formed by the upper and lower sheets 29 and 30 being joined together provide desired shape and load supporting characteristics for the cover 26. In all other respects, the first and second embodiments are the same.

Figure 8:
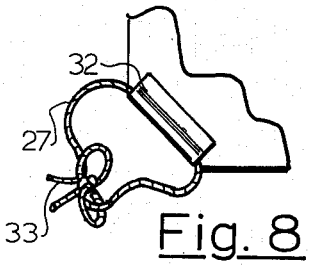
FIG. 8 is a fragmentary view of a corner of FIG. 6 showing an alternate embodiment for retaining the cover to a mattress.

Referring to FIG. 8, one corner of the third embodiment is shown. The third embodiment is the same as the second embodiment in all respects except for the cord 27 which is cut to a given length and tied in a knot 33 for retaining the cover 26 to the mattress 12. The material for the cord 27 may optionally be elastic.

While three specific embodiments of the present invention have been shown, it will be appreciated that other embodiments drawing from individual features of the shown embodiments can be provided. For example, the different types of flaps specified for retaining the cover to a mattress can be used without regard to the configuration of the depressions in the upper and lower sheets used for providing desired load and shape characteristics. Also, it is possible to construct the corner flaps of the shown embodiments with their respective passageways by cutting only a single sheet having a flap at each corner and folding and joining the free end of each flap onto itself.

Having now described my invention and the manner of making and using it, one can see that which has been achieved is a fire extinguishing mattress cover which is low in cost, adaptable to currently used mattresses, effective for reducing the hazards of bedding fires, and provides an improvement in comfort.

What I claim is new is:

1. A liquid filled cover for extinguishing and preventing bedding fires in combination with a mattress said cover having a low resistance to penetration by fire and hot objects capable of initiating fire with quick release and free flow of the confined liquid internally and externally from said cover comprising:

upper and lower horizontally disposed sheets of thin material having a low resistance to penetration by fire and hot objects capable of initiating fire joined at their outermost edges to form a leakproof enclosure having a shape for substantially covering the top surface of a mattress and a relatively small height as compared the the length and breath;

a fire extinguishing liquid confined within said cover until caused to be released quickly and free flow when said cover is penetrated by fire and hot objects capable of initiating fire; and a closure means for adding and removing the fire extinguishing liquid from said cover.

2. A fire extinguishing mattress cover in combination with a mattress according to claim 1 with a means for retaining and locating said cover to said mattress which incudes:

flaps at the corners of said cover having transverse passageways at their ends; and a single cord threaded through said passageways for retaining said cover to said mattress.

3. A fire extinguishing mattress cover in combination with a mattress according to claim 2 having said upper and lower sheets with a plurality of symmetrically opposed circular depressions, corresponding symmetrically opposed depressions being joined together.

4. A fire extinguishing mattress cover in combination with a mattress according to claim 2 having said upper and lower sheets with a plurality of symmetrically opposed longitudinal depressions, corresponding symmetrically opposed depressions being joined together.

5. A fire extinguishing mattress cover in combination with a mattress according to claim 1 with a means for retaining and locating said cover to said mattress which includes:

corners of said cover having transverse passageways; and a loop shaped retaining cord threaded through each said passageway for retaining said cover to said mattress.

6. A fire extinguishing mattress cover in combination with a mattress according to claim 5 having said upper and lower sheets with a plurality of symmetrically opposed circular depressions, corresponding symmetrically opposed depressions being joined together.

7. A fire extinguishing mattress cover in combination with a mattress according to claim 5 having said upper and lower sheets with a plurality of symmetrically opposed longitudinal depressions, corresponding symmetrically opposed depressions being joined together.

8. A fire extinguishing mattress cover in combination with a mattress according to claim 1 with a means for retaining and locating said cover to said mattress which includes:

corners of said cover having transverse passageways; and a retaining cord cut to a given length threaded through each said passageway whereby the retaining cord is tied for retaining said cover to said mattress.

9. A fire extinguishing mattress cover in combination with a mattress according to claim 8 having said upper and lower sheets with a plurality of symmetrically opposed circular depression, corresponding symmetrically opposed depressions being joined together.

10. A fire extinguishing mattress cover in combination with a mattress according to claim 8 having said upper and lower sheets with a plurality of symmetrically opposed longitudinal depressions, corresponding symmetrically opposed depressions being joined together.

11. A liquid filled cover for extinguishing and preventing bedding fires in combination with a mattress said cover having a low resistance to penetration by fire and hot objects capable of initiating fire with quick release and free flow of the confined liquid internally and externally from said cover comprising:

upper and lower horizontally disposed sheets of thin material having a low resistance to penetration by fire and hot objects capable of initiating fire joined at their outermost edges to form a leakproof enclosure having a shape for substantially covering the top surface of a mattress and a relatively small height as compared to the length and breath;

a fire extinguishing liquid confined within said cover until caused to be released quickly and free flow when said cover is penetrated by fire and hot objects capable of initiating fire;

a closure means for adding or removing the fire extinguishing liquid from said cover;

a means for retaining and locating the liquid filled cover on the top surface of the mattress; and a plurality of symmetrically opposed depressions in the upper and lower sheets, corresponding symmetrically opposed depressions being joined together.

* * * * *